US005551181A

United States Patent [19]

Upton

[11] Patent Number: 5,551,181

[45] Date of Patent: Sep. 3, 1996

[54] GUN LOCK

[75] Inventor: Bruce M. Upton, Roseville, Australia

[73] Assignee: McDonald Upton Limited, Auckland, New Zealand

[21] Appl. No.: 318,756

[22] PCT Filed: Apr. 13, 1993

[86] PCT No.: PCT/AU93/00165

§ 371 Date: Jan. 30, 1995

§ 102(e) Date: Jan. 30, 1995

[87] PCT Pub. No.: WO93/21491

PCT Pub. Date: Oct. 28, 1993

[30] Foreign Application Priority Data

Apr. 13, 1992 [AU] Australia ..... 921888

[51] Int. Cl.[6] ..... F41A 17/54; F41A 17/02

[52] U.S. Cl. ..... 42/70.11; 42/70.07

[58] Field of Search ..... 42/70.07, 70.06, 42/70.11

[56] References Cited

U.S. PATENT DOCUMENTS

| | | | |
|---|---|---|---|
| 1,686,482 | 10/1928 | Windle | 42/70.07 |
| 3,031,787 | 5/1962 | Womble, Jr. | 42/70.07 |
| 3,139,694 | 7/1964 | Schaefer | 42/70.07 |
| 3,624,945 | 12/1971 | Foote | 42/70.07 |
| 3,934,768 | 1/1976 | Jones | 224/1 R |
| 4,122,620 | 10/1978 | Alexander | 42/70.11 |
| 4,509,281 | 4/1985 | Dreiling et al. | 42/70.07 |
| 4,934,083 | 6/1990 | Smith | 42/70.11 |
| 5,153,360 | 10/1992 | Upton | 42/70.07 |
| 5,191,158 | 3/1993 | Fuller et al. | 42/70.07 |

FOREIGN PATENT DOCUMENTS

| | | | |
|---|---|---|---|
| 8587491 | 4/1992 | Australia | 42/70.11 |
| 968669 | 9/1964 | United Kingdom . | |
| 1157247 | 7/1969 | United Kingdom . | |

*Primary Examiner*—Stephen M. Johnson
*Attorney, Agent, or Firm*—Loeb & Loeb LLP

[57] ABSTRACT

A gun lock 10 to surround the trigger and trigger guard of a gun 11. The lock 10 has a pair of shield halves 13 and 14 which prevent access to the trigger. The shield halves 13 and 14 are held together by means of a threaded shaft 15 and threaded passage 22 which co-operate, in addition to a shackle member 23 which also extends between the shield halves 13 and 14. A key operable lock barrel 19 is operable to retain the shackle member 23 attached to the shield halves 13 and 14 and is operable to release the shackle member 23.

10 Claims, 3 Drawing Sheets

GUN LOCK

FIELD OF THE INVENTION

The present invention relates to gun locks and more particularly to gun locks having a split casing for enclosing a trigger and trigger guard associated therewith, and means to secure the gun lock and its associated gun to a fixture to prevent unauthorized removal of the gun.

BACKGROUND OF THE INVENTION

Gun locks have frequently included just a single lock which secures the gun to a rack which upon being unlocked renders the gun ready for use. Still further, such locks cannot be employed once the lock has been removed from the rack, to inhibit use of the gun.

British Patent 968669 discloses a gun lock which fits around the trigger guard and prevents access to the trigger. The particular lock is not intended for securing to a wall or other structure. Similar comments also apply to the lock which is described in U.S. Pat. No. 3,624,945.

Disclosed in Australian Patent Application 85874/91 (U.S. Pat. No. 5,153,360) is 2 gun lock having trigger shields. The shields are held together by means of a bolt, access to which is prevented by a cylinder lock.

OBJECT OF THE INVENTION

It is the object of the present invention to overcome or substantially ameliorate the above disadvantages.

SUMMARY OF THE INVENTION

There is disclosed herein a gun lock for a gun having a trigger and trigger guard, said gun lock comprising:

- a pair of shield halves co-operating to enclose the trigger to prevent access thereto by being located on opposite sides of the trigger guard;
- a shackle member to straddle the gun and having a pair of spaced arms to engage the shield halves to prevent removal of the shield halves from a position enclosing the trigger; and
- lock means operable to secure the shackle member to the shield halves to prevent removal of the shackle member from the shield halves.

Preferably the shackle member which straddles the gun is adapted to engage a wall bracket; the wall bracket in turn being adapted to be secured to a wall or floor so that when the gun is secured thereto, unauthorised removal of the gun is inhibited.

BRIEF DESCRIPTION OF THE DRAWINGS

A preferred form of the present invention will now be described by way of example with reference to the accompanying drawings wherein.

DETAILED DESCRIPTION OF THE PREFERRED EMBODIMENT

Figure 1:
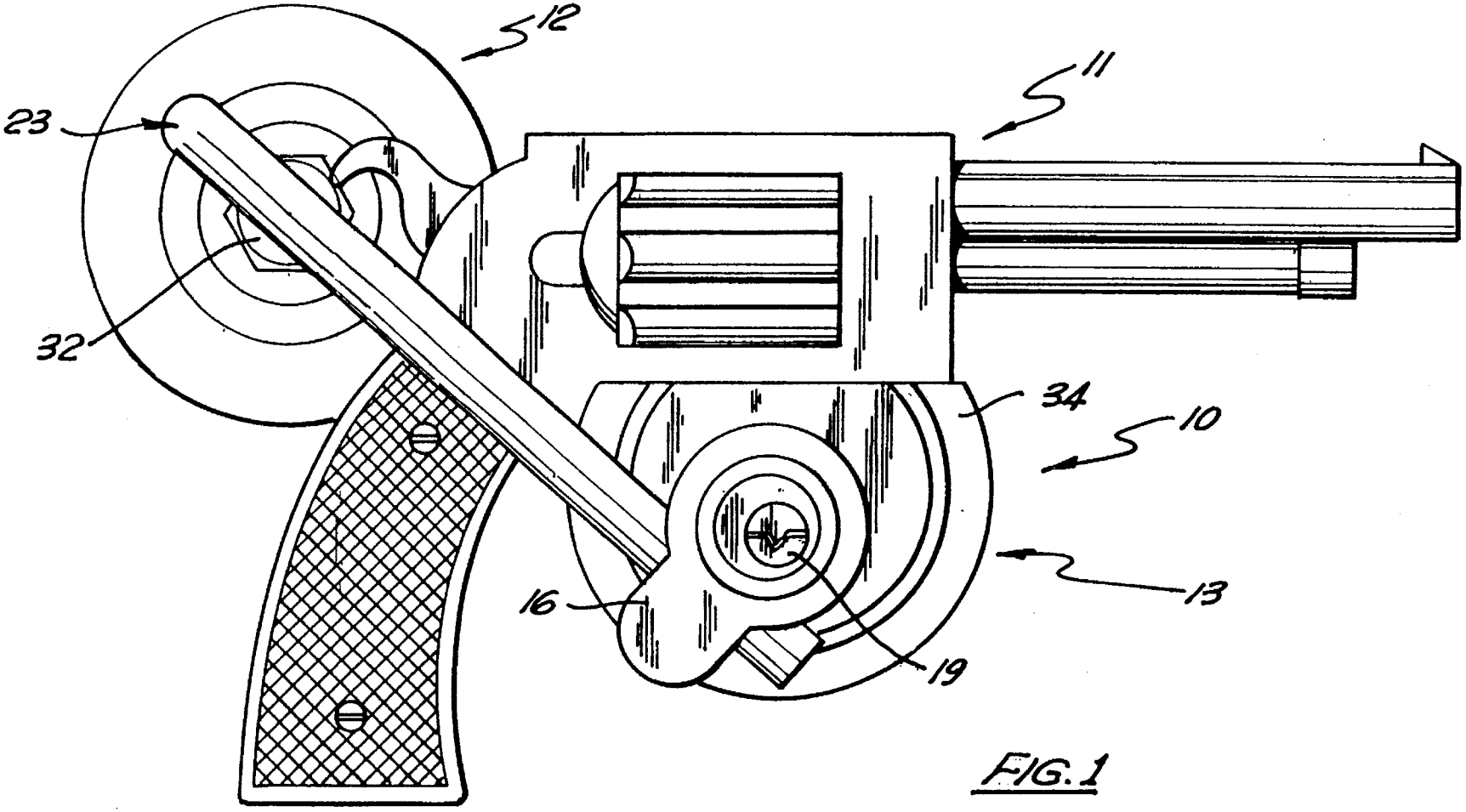
FIG. 1 is a schematic side elevation of a gun, gun lock and wall mounting bracket.
Figure 2A:
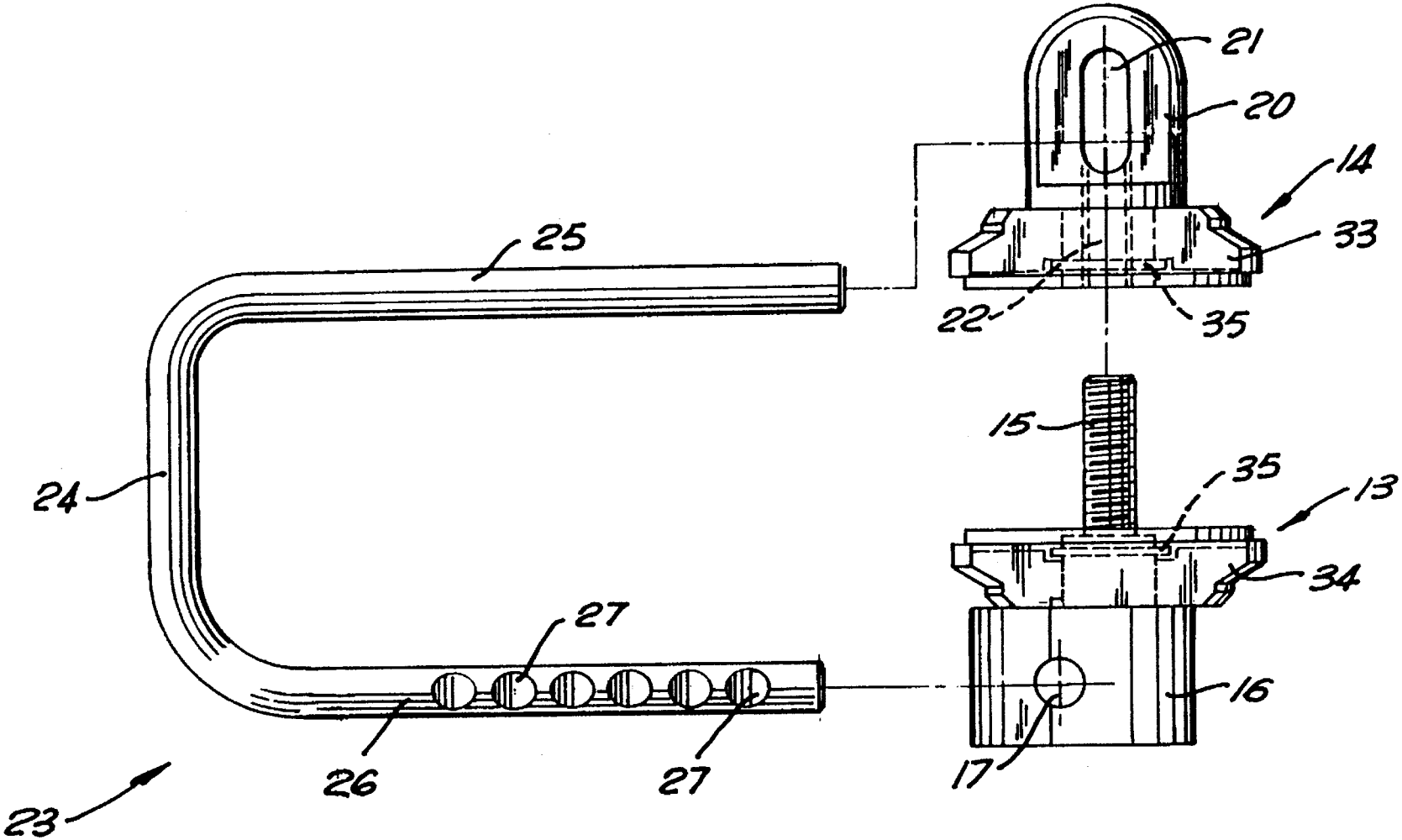
FIG. 2A is a schematic parts exploded view of the gun lock of FIG. 1.
Figure 2B:
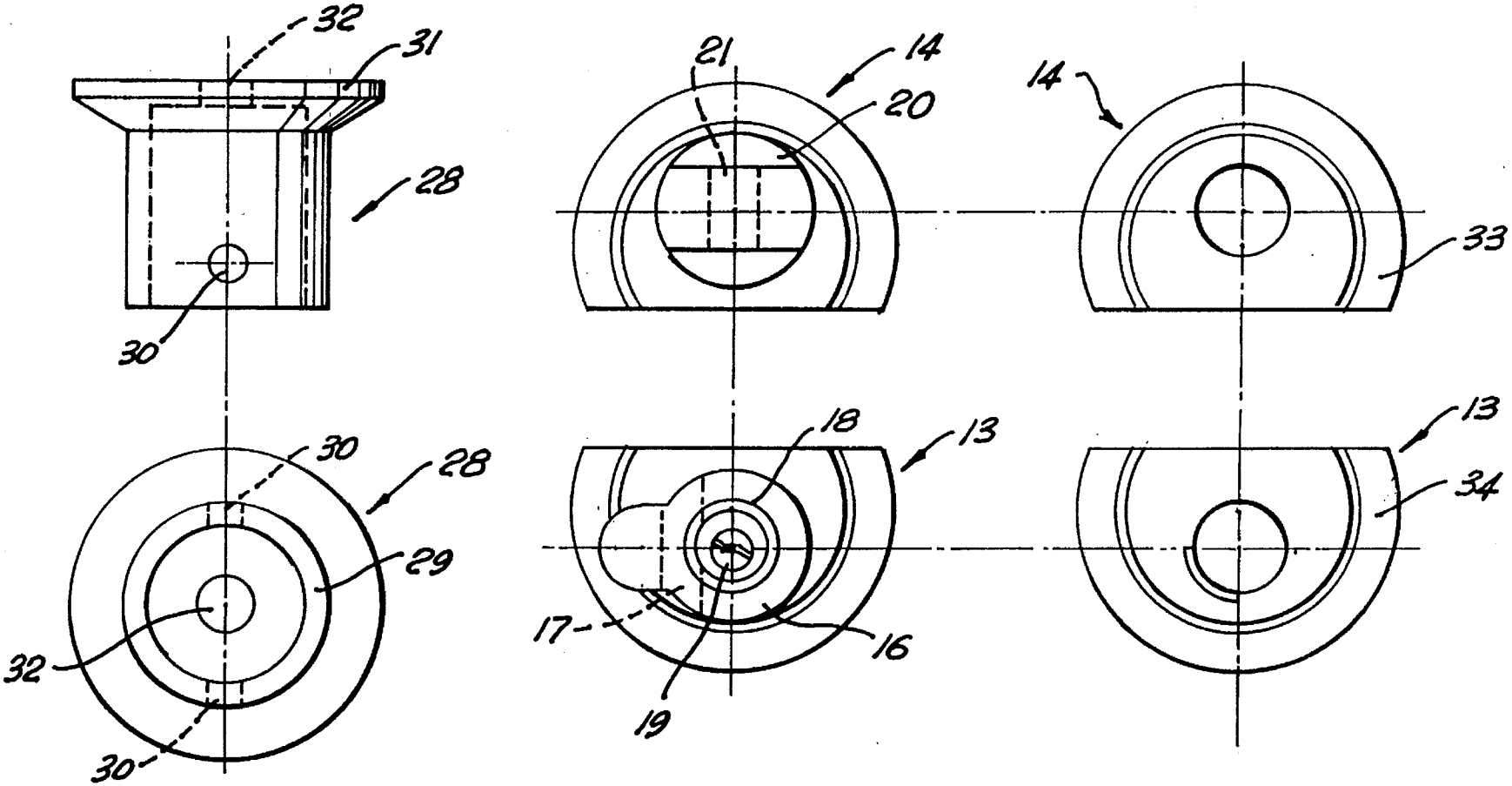
FIG. 2B is a detailed view of the shelve halves and wall bracket assembly.

In the accompanying drawings there is schematically dépicted a gun lock 10 to surround the trigger and trigger guard of a gun 11. The lock 10 is also adapted to co-operate with a wall bracket 12 which is intended to be secured to a structure (such as a wall or floor).

The lock 10 includes a pair of shield halves 13 and 14 which are intended to be located on opposite sides of the trigger guard. The shield half 13 has a threaded shaft 15 and a projection 16 fixed thereto. The projection 16 and shaft 15 are rotatably mounted in the flange 34. The projection 16 has a shackle passage 17 which intersects with a further passage 18 which receives a lock assembly including a barrel 19. When the lock barrel 19 is located in the passage 18, the lock barrel partly protrudes into the shackle passage 17. More particularly, the lock barrel 19 is operable by means of a key to be retained in the projection 16. Upon operation of the key, the barrel can be removed or located in a position not intersecting with the passage 17. Preferably the barrel 19 is captively located within the passage 18, and has an eccentric projection which is movable to engage within the recess 27. The projection being eccentric with respect to the rotational axis of the barrel 19.

As a still further construction of the barrel 19 could include an end shaft portion with a "cut out" which when positioned adjacent the shackle member 23, permitted movement thereof. However upon rotation of the barrel 19, the shaft portion would enter the recess 27.

The shield half 14 includes a flange 33, which rotatably supports a projection 20 having a shackle passage 21. The projection 20 also has a threaded passage 22 to threadably engage the shaft 15. Accordingly upon engagement of the shaft 15 within the passage 22, and relative rotation between the projection 20 and projection 16, the shaft 15 will enter the passage 22 and prevent separation of the shield halves 13 and 14.

It should be appreciated that although in this embodiment both the shaft 15 and passage 22 can be rotated with respect to their respective flange 33, 34, only one need be rotated. Still further, other securing means can be employed to extend between the projections 16 and 20, rather than a shaft and threaded passage.

Circlips 35 retain the projections 16 and 20 fixed to their respective flanges 33 and 34.

The gun lock 10 further includes a shackle member 23 which in this embodiment is of a "U-shaped" configuration, so as to have a base 24 joining two generally parallel co-extensive arms 25 and 26. The arm 26 is provided with a series of recesses 27 to co-operate with the lock barrel 19. The arms 25 and 26 are adapted to enter the shackle passages 17 and 21 to prevent relative movement between the shield halves 13 and 14, to thereby prevent removal of the gun lock 10. When the arm 26 is located in the passage 17, the lock barrel 19 may be inserted or moved so as to be located in one of the recesses 27 to prevent removal of the shackle member 23.

The shackle member 23 is intended to co-operate with a floor or wall mountable bracket 28. The bracket 28 has a cylindrical wall 29 through which there passes aligned passages 30. The arm 25 is intended to pass through the passages 30 and then into the passage 21, to secure the gun lock 10, and therefore the gun 11, to the wall or the floor. The base 31 of the bracket 28 has a passage 32 through which a bolt or other fastener may pass to secure the bracket 28 to an associated structure. A bolt 33 passes through the passage 32 to engage the associated structure. The shackle member 23 would then inhibit or prevent removal of the bolt 33 when the arm 25 is located in the passages 30.

I claim:

1. A gun lock for a gun having a trigger and trigger guard, said gun lock comprising:

a pair of shield halves co-operating to enclose the trigger to prevent access thereto by being located on opposite sides of the trigger guard;

a shackle member to straddle the gun and having a pair of spaced arms to engage the shield halves to prevent the removal of the shield halves from a position enclosing the trigger;

lock means operable to secure a first one of said spaced arms of said shackle member to a first one of the shield halves to prevent removal of the shackle member from the shield halves; and a wall mountable bracket, said bracket having a passage through which a second one of said spaced arms of said shackle member passes to secure the gun to said bracket; wherein a second one of said shield halves is adapted to receive said second one of said spaced arms.

2. The gun lock of claim 1, wherein one of said shield halves has a threaded shaft, and the other shield half has a threaded passage to threadably receive said threaded shaft so that relative rotation between the shield halves secures the halves together, with said shackle member when engaged with said shield halves preventing relative rotation and therefore separation of said shield halves.

3. The gun lock of claim 2, wherein each shield half has an arm-receiving passage into which one of the associated spaced arms of said shackle member is to enter, and said lock means is mounted in one of the shield halves and engages one of the spaced arms of said shackle to prevent removal of said one spaced arm of said shackle from its associated shield half.

4. The gun lock of claim 3, wherein said one of the spaced arms of said shackle member has at least one recess, and said lock means engages within said recess when engaging the shackle member to the associated shield half.

5. The gun lock of claim 3, wherein said spaced arms of said shackle member are rigid.

6. The gun lock of claim 4, wherein said lock means is rotatably mounted in its associated shield half and is rotatable about an axis generally transverse of said first one of said spaced arms.

7. The gun lock of claim 6, wherein said lock means has an eccentric portion which when rotated about the axis of said lock means moves into or out of engagement with respect to said recess.

8. The gun lock of claim 7 wherein said lock means includes a key operable lock barrel with said eccentric portion, and said barrel is captively located with respect to its associated shield half.

9. The gun lock of claim 7, wherein the arm-receiving passages extend in a direction generally parallel to the shackle arms and normal to the longitudinal axis of said shaft and generally normal to the rotational axis of said lock means.

10. The gun lock of claim 1 wherein said lock means includes a key operable lock barrel captively located with respect to one of said shield halves, and rotatable between a retaining position and a release position with respect to said shackle member.

* * * * *